United States Patent [19]

Knabe et al.

[11] 4,171,714

[45] Oct. 23, 1979

[54] FILLING MACHINE FOR CHARGING CONTAINERS WITH A LIQUID

[75] Inventors: Uwe Knabe; Wolfgang Borstelmann, both of Dortmund, Fed. Rep. of Germany

[73] Assignee: Holstein & Kappert GmbH, Dortmund, Fed. Rep. of Germany

[21] Appl. No.: 913,868

[22] Filed: Jun. 8, 1978

[30] Foreign Application Priority Data

Jun. 15, 1977 [DE] Fed. Rep. of Germany ..... 2726935

[51] Int. Cl.[2] ..... B67C 3/00; B65B 3/06

[52] U.S. Cl. ..... 141/37; 141/303; 251/318

[58] Field of Search ..... 141/1, 4–8, 141/37, 39, 54, 46, 192, 197, 198, 286, 40, 49, 52, 53, 302, 57, 58, 63, 64, 227, 303, 153, 144–152; 251/318

[56] References Cited

U.S. PATENT DOCUMENTS 3,799,219 3/1974 Uth et al. ..... 141/39

*Primary Examiner*—Houston S. Bell

*Attorney, Agent, or Firm*—Michael J. Striker

[57] ABSTRACT

The filling machine has a rotary tank containing the liquid, an annular channel surrounding the tank and containing gas having a lower pressure than the gas in the tank but higher than the atmospheric pressure, a filling unit adapted for sealing the container to be filled and including a filling pipe communicating with the interior of the tank and projecting into the container to be filled, a pressure control space communicating with the interior of the container around the filling pipe and connectable via a first control valve to the outer atmosphere, and further connectable via a second control valve to the annular channel, the second control valve being opened mechanically in response to the angular position of the rotary liquid tank and in addition being controlled during its open position by a separate timing device that closes the second valve if the mechanical control exceeds a predetermined time.

10 Claims, 5 Drawing Figures

20
19
5
1
23
34
22
33'
33
35,36
37
21

FILLING MACHINE FOR CHARGING CONTAINERS WITH A LIQUID

BACKGROUND OF THE INVENTION

This invention relates generally to bottling machines and in particular it relates to a filling machine for charging containers, such as bottles and the like, with a liquid from an annular tank equipped with a filling system having a liquid discharging pipe, a gas returning conduit and a pressure control space surrounding the filling pipe and connectable through a pressure relief channel with the outer atmosphere.

In German Pat. No. DP-GBM 1.968.011 a filling system is described which includes a valve arranged in the gas return conduit opening into the gas pressure space of a rotary liquid tank and permitting a connection of the gas return conduit with the outer atmosphere. The control of this valve is effected by means of stationary stops or cam surfaces arranged in the path of movement of the tank and abutting against projecting push rods of the valve. The system has further a filling unit including a filling valve in the form of an elongated pipe and upon applying the filling unit against the container to be filled the pressure between the container and the tank is equalized. As soon as the equal pressure in the container is built up, the filling valve opens and the liquid flows into the bottles by the action of gravity. In addition, there is provided a device that makes it possible to create a pressure difference resulting in an increased speed of the liquid during its discharge to the bottle. In the normal course of filling operations the valve arranged in the gas return channel communicating with the liquid tank is opened and connects the gas return conduit to the outer atmosphere. Consequently a considerable pressure difference is created that effects a faster discharge of the liquid. The valve itself is controlled by means of outside control cams arranged at the circular track of the filling machine. If the filling machine for one reason or another decelerates its rotary motion, or if it stops and starts again, there is no possibility to control this valve so that the quick filling action continues until the whole filling process is terminated. This shortcoming, however, can make considerable operational difficulties since during the slowdown of the movement of the filling machine a considerable part of the liquid is discharged into widely branched channels in the filling unit and the spilled liquid can prevent an exact definition of the filling level that is essential in the filling operation. This failure occurs not only during a momentary interruption of the rotary movement of the filling machine but also during its coasting or restarting. In the endeavor to diminish this disturbance, the stationary control cams for each atmosphere valve has been made tiltable. In modern bottling machines having large diameters and circumferential speeds this tiltable arrangement is no longer applicable because due to correspondingly increased power the inertia effects of the system would prevent an exact control. For example, the auxiliary mechanical control of the cams is completely out of the question in filling machines controlled according to their output so that all cooperating devices are correlated according to the rate of the liquid discharge. Another disadvantage of the known devices resides in the fact that due to relatively narrow channels the liquid particles produce undefinable throttling or choking effects so that pressure differences vary and these pressure variations may cause again inaccurate filling of the bottles. These undesired effects may take place even in an arrangement where, in order to define the pressure difference, chokes or restrictions are provided in the return gas or return air conduits because bubbles especially in the case of $CO_2$ containing liquids, and/or liquid remainders change the prearranged choking gap.

SUMMARY OF THE INVENTION

It is therefore a general object of this invention to overcome the aforementioned disadvantages.

More particularly, it is an object of the invention to provide an improved filling system for the filling machines of the above-described type.

An additional object of the invention is to provide a filling system that enables a time control of the quick filling phase of the filling operation independently from pressure conditions in the system.

A further object of the invention is to provide controlling means for insuring an accurate filling of the containers within a predetermined time interval.

An additional object of the invention is to provide such an improved filling control device that avoids the disturbances that hitherto have resulted during the coasting and restarting of the bottling machine.

A still further object of the invention is to provide a filling control device that prevents changed operational conditions of the machine resulting from the interruption of its operation from influencing the preselected time interval for filling, and avoids the extension of the quick filling phase over a predetermined volume of the discharged liquid.

A still additional object of the invention is to provide such an improved filling system that can dispense with the external controlling surfaces or cams.

In keeping with these objects, and others which will become apparent hereafter, one feature of the invention resides, in a filling machine of the above-described type, in a combination which comprises an annular intermediate pressure channel surrounding the liquid tank, the pressure in this channel being reduced with respect to the gas pressure in the liquid tank but higher than the pressure of ambient atmosphere, a pressure change-over passage provided in the filling head between the pressure control space in the filling head and the annular intermediate pressure channel, a control valve arranged in this changeover passage and cooperating with external control means to open the passage for a short period determining the quick filling action of the filling system, and timing means for keeping the open condition of the control valve for a predetermined time interval independently of the action of the external control means.

In an advantageous embodiment of the invention the control valve is arranged in the pressure changeover passage between the pressure control space in the filling head and the annular pressure channel, the piston of the valve being integral with a projecting control pin controllable by an external cam via a double arm lever that cooperates with a timed resetting element that in adjustable limits counteracts the closing force of the valve.

In a modification of the invention, the control rod of the valve is actuated by a solenoid that in turn is controlled by means of a mechanically controlled wiper switch in connection with a condenser defining the time interval in which the electromagnet or solenoid is held in its working position.

In another modification of the invention the pressure changeover passage in the range of the space for the piston of the control valve that connects and disconnects the changeover passage to the intermediate pressure channel, is provided with an additional cylindrical space for accommodating an extension of the piston of the control valve the additional cylindrical space being connected to a pressure relief valve and by means of a throttle conduit to the changeover passage and therefrom to the pressure control space in the filling head. The control pin actuating the piston plate actuates in a first stage the piston plate of the pressure relief valve communicating with the additional cylindrical space and thereafter, in a second stage, it opens the control valve communicating with the annular intermediate pressure channel.

It has proved to be advantageous when the control pin of the pressure relief valve is concentrically arranged within the control bolt or pin of the control valve and projects slightly above the latter.

In still another modification of the invention the control bolt of the main control valve has on its surface a helical or screw-like projection engaging a complementary shape in the housing of the valve whereby a brake element for delaying the resetting speed is coupled to the control bolt.

It is also within the scope of the invention that electrooptical sensors are arranged in operative proximity to the circular track of the filling machine to determine at least the end of the quick filling phase of the filling process. The control pulse from the output of the electrooptic element controls in closing direction the control valve communicating with the annular channel.

According to this invention it is advantageous if the sensors are adjustably arranged relative to each other and also if they are vertically adjustable. Furthermore, it is advantageous if the pressure inside the pressure tank of the filling machine is at the ratio 2.0:1.5 relative to the pressure in the annular channel.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

DESCRIPTION OF THE PREFERRED EMBODIMENTS

Figure 1:
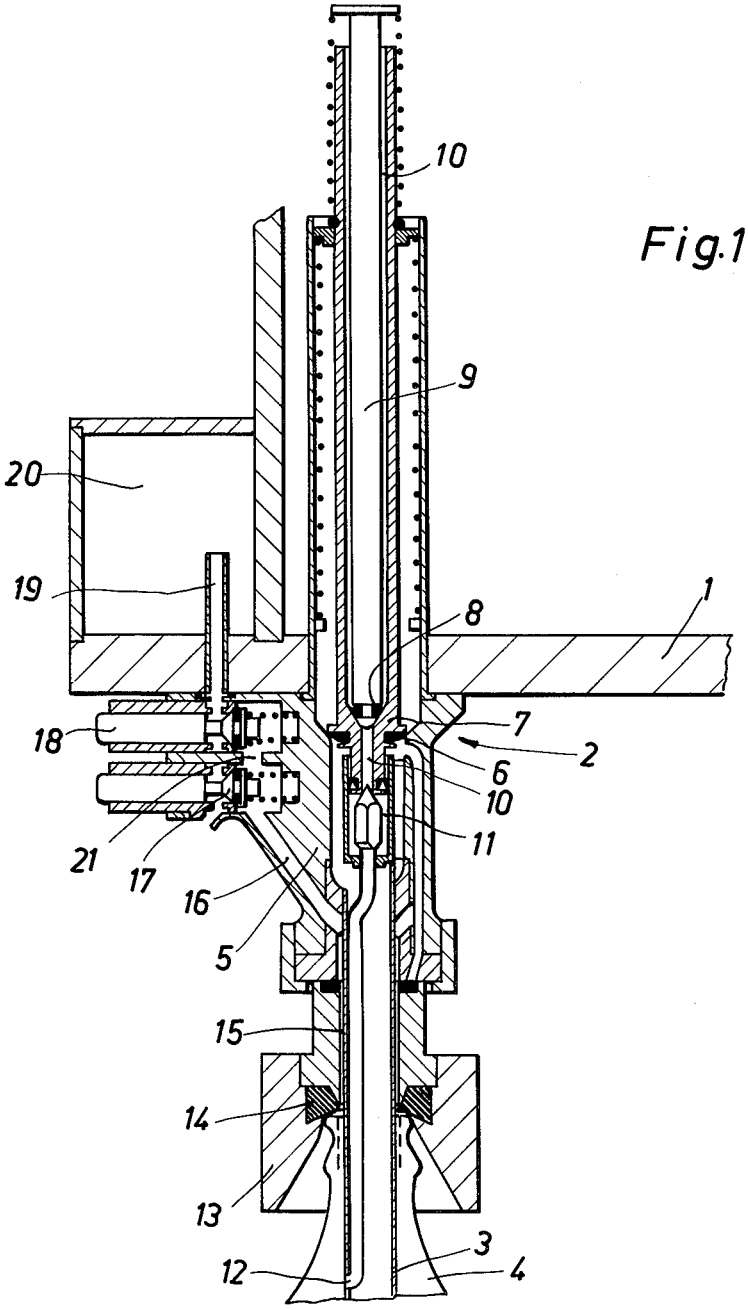
FIG. 1 is a sectional side view of the filling system according to this invention.

Referring firstly to FIG. 1, the filling machine comprises a rotary annular liquid tank 1 provided with a filling system 2 that includes a filling pipe 3 projecting downwardly from the bottom of the tank 1 into the interior of a bottle or container 4 to be filled with a liquid from the tank 1. The filling pipe 3 is firmly connected to a filling head 5 in which a valve seat 6 is formed to support a tubular valve body 7 projecting into the interior of the liquid tank 1. The valve body 7 together with its closing portion is movable in axial direction to open and to close the fluid discharging pipe 3. Inside the tubular valve body 7, another valve seat 8 is provided to cooperate with a valve disc at the end of a rod 9 arranged in and projecting from the tubular valve body 7. The annular space between the interior of the valve body 7 and the rod 9 acts as pressure gas conduit between the interior of the tank 1 and the container or bottle to be filled. This pressure gas conduit 10 opens into a float chamber 11 and therefrom it extends downwardly into the filling pipe 3 and opens through port 12 into the interior of the container or bottle 4. The position of the port 12 in the bottle determines the level to which the bottle is charged with the liquid. An outer surface portion of the pipe 3 supports and guides a centering attachment 13 provided with seals 14 which abut against the rim of the bottle neck and seal an annular control space 15 provided in the filling head 5 and attachment 13, from the outer atmosphere. This sealed-off control space 15 communicates with a gas relief passage 16. In addition, the passage 16 is further connected through a changeover passage 21 with an additional or control valve 18 which opens through upwardly directed conduit 19 into an annular channel 20 arranged around the tank 1.

The gas pressure inside the annular channel 20 is lower than that in the tank 1 but higher than the atmospheric pressure. The actual pressure conditions are adjusted according to the type of liquid in the tank 1.

The filling process is started by opening the gas valve 8. This opening is carried out automatically by means of a control pinion (not shown) that is arranged at the annular channel 20 and during rotation of the machine engages with a stationary control mechanism that is adapted for lifting the rod 9. By this action the pressure difference between the interior of bottle 4 and the interior of tank 1 is equalized and as a result the spring-biased tubular valve body 7 moves upwardly so that liquid from tank 1 flows by gravity into the bottle 4. As soon as a certain preliminary amount of liquid is discharged into the bottle 4 the projecting piston or control pin of the additional control valve 18 is depressed to open the connection between the interior of the bottle 4 and the interior of the annular channel 20 containing gas having reduced pressure. In this manner, a pressure difference is created between the interior of the bottle 4 and tank 1 and the reduced pressure in the bottle accelerates the discharge of the liquid. This quick filling phase, however, especially in the case of liquids containing $CO_2$ cannot last until the end of the filling process since due to increased speed of discharge the gas contained in the liquid is set free and would impair the accuracy of filling. Moreover, a portion of the liquid would reach the conduits in the control head 5 and upon the pressure relief in the control space 15 the spilled liquid would influence in an unpredictable manner the filling level in the bottle and the aforementioned advantages resulting from the additional use of a pressure space having a constant pressure would be nullified.

For this reason it is necessary that the quick filling phase be carried out within a predetermined time interval that is independent from the rotational speeds of the machine. If the control cam or surface is arranged at the circular track of the rotary filling machine to engage for a moment the control pin of valve 18, a well-definable time interval can be achieved only when a uniform rate of discharge of the liquid or a constant rotary speed of the machine is maintained. In practice, this condition can hardly be fulfilled because due to continuously changing operational conditions of associated operational devices there always result different rates of discharge from the filling machine.

Figure 2:
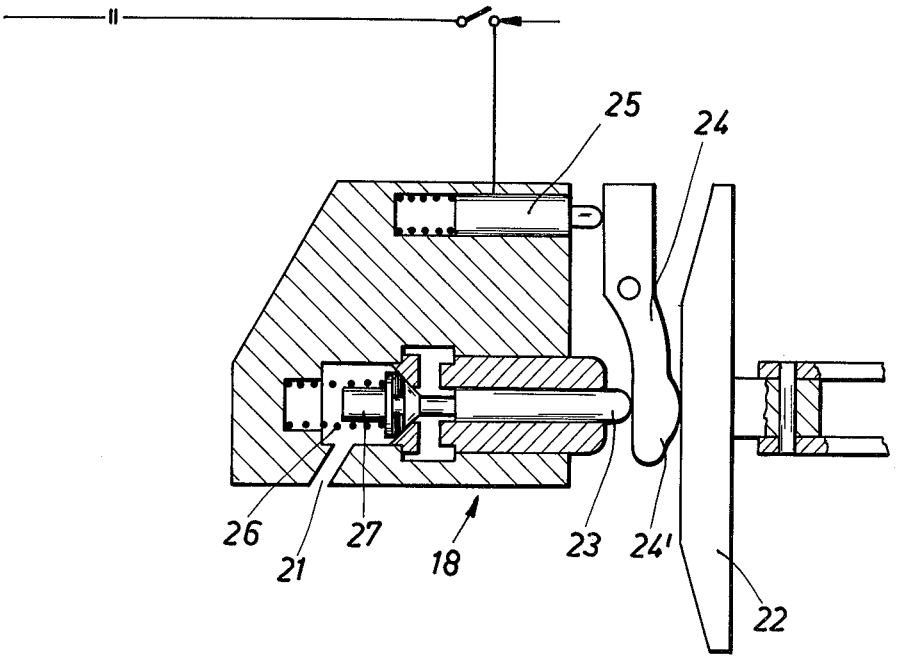
FIG. 2 is a schematical sectional view of the automatic time controlling arrangement of the control valve in the filling device of this invention.

To maintain the quick filling phase in the prescribed time interval, a time control arrangement, one embodiment of which is shown in FIG. 2, is assigned to the control valve 18. According to this embodiment, one arm 24' of a two-armed lever 24 is arranged between a stationary control cam 22 and control pin 23 of the circulating control valve 18. The other arm of the lever 24 is in contact with resetting element 25 controllable in response to a timing circuit defined by a switch and a capacitor. The resetting element 25 includes a solenoid and counteracts via the two-armed lever 24 the spring 26 that normally urges the valve piston 27 in closing direction. By means of a timing circuit including a condenser and a switch the actuation of the resetting element can be adjusted within desired time limits. The actuation member 25 is effected even when the filling machine for one reason or another decelerates its rotational speed and the control pin 23 remains in the range of the control cam 22 for an increased time period. By actuating the resetting element 25, the prolongation of the quick filling phase over a desired limit in the critical range is prevented.

Figure 3:
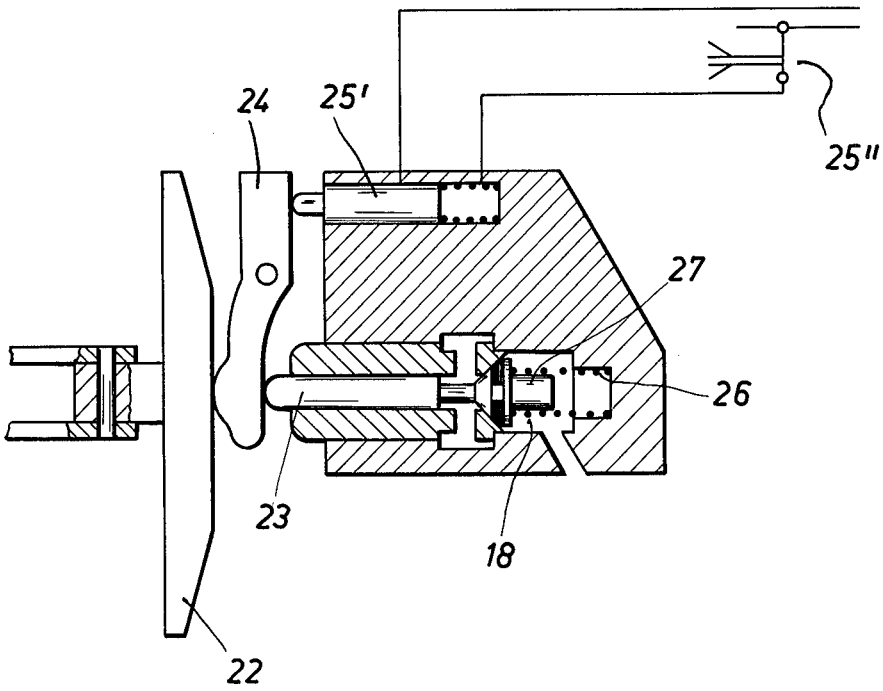
FIG. 3 is a modification of the device of FIG. 2.

In the embodiment shown in FIG. 3 the resetting element 25' includes a solenoid that is coupled with control pin 23 of control valve 18 via the two arm lever 24; similarly as in the preceding example, a wiper switch 25'' is released by control cam 22 and by means of a condenser it energizes the solenoid 25' for a predetermined time interval to lift the plunger of the solenoid and thus open the valve 18.

Figure 4:
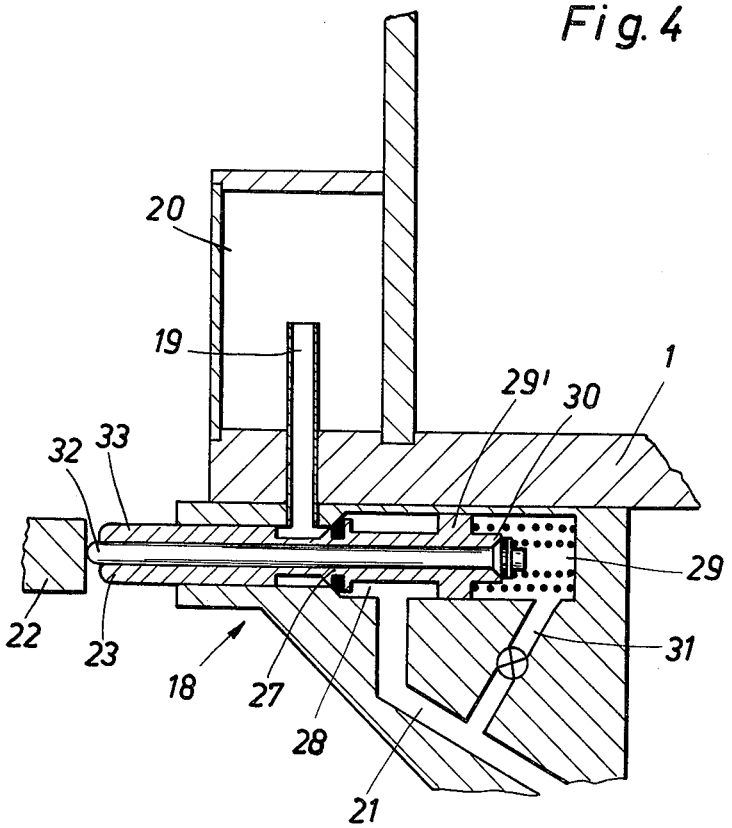
FIG. 4 is a sectional view of a self-resetting control valve according to this invention.

Another modification is shown in FIG. 4. In this embodiment the control valve 18 includes, in addition to the pressure space 28 cooperating with the pressure difference or changeover conduit 21, an additional cylindrical space 29 for accommodating piston 29' that is integrally connected with the closing valve surface 27 and with projecting control pin 23. The control pin 23 has a central bore in which an auxiliary control pin 32 is arranged for reciprocal movement. One end of the auxiliary control pin 32 projects slightly above the top of the main control pin 23 and the other end of the auxiliary control pin is terminated with a pressure relief valve 30. The cylindrical space 29 is connected with the pressure changeover or difference conduit 21 by a throttle conduit 31. As soon as control cam 22 activates the control valve 18, first the pressure relief valve 30 is opened by means of the projecting tip of the auxiliary control pin 32 and as a result the cylindrical space 29 is completely pressure relieved and has the pressure of the outer atmosphere. Thereupon the main control pin 23 is depressed and the pressure space 15 together with the conduit 21 and the interior of the bottle is connected to the annular channel 20 so that the resulting pressure difference initiates the quick filling phase. Simultaneously a reduced gas stream flows through throttle conduit 31 into the cylindrical space 29 and upon closing of the valve 30 it assists to a tension spring provided in the cylindrical space 29 to close gradually the piston 27 of the valve 18. This slow closing action can be adjusted by corresponding adjustment of the annular surface in the space 28. In the particular structure of the control valve 18 as shown in FIG. 4, a minute control impulse from the control cam 22 is sufficient for initiating the quick filling phase whereby the resetting of the control valve 18 is independent from the control cam surface or the length of the cam 22. According to the configuration of the starting range of control cam 22 different travels of the valves 27 and 30 can be adjusted. In this manner an arbitrary adjustment of the resetting time corresponding to the desired amount of liquid to be filled can be made according to the actual size of the bottles.

Figure 5:
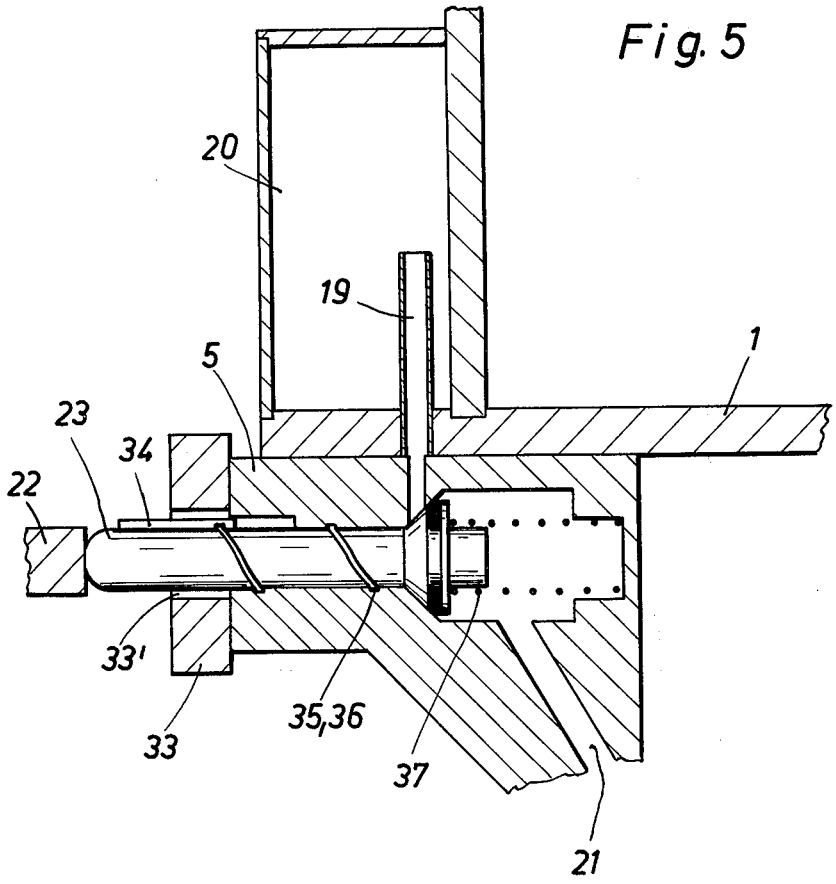
FIG. 5 is another modification of the control valve having a speed controlling braking member.

In the embodiment according to FIG. 5 the time dependent resetting of the control valve is carried out by means of a braking element 33 filled with silicon for example, and having at its central part a race or circular track 33'. The circular track 3' is coupled with a control pin 23 by means of at least one grooved member 34. The element 33 is mounted on the control head 5. The control pin 23 is provided on its surface with a helical projection 35 having a high pitch and engaging corresponding grooves in the supporting boring 36. As soon as the control pin 23 is actuated by the control cam or by a similar controlling element, the helical projections or threads 35 cause rotation of the control pin 23 during its movement in opening direction. A tension spring 37 urges the piston of the valve into its closing position. The speed of the resetting movement can be adjusted by the braking element 33 so that even in this case it is possible to maintain exact timing of the quick filling phase independently from the time interval that is defined by the movement of the control cam 22. Also in this case the control cam is to be made as short as possible in order to introduce the starting point only without influencing the resetting movement.

It will be understood that each of the elements described above, or two or more together, may also find a useful application in other types of constructions differing from the types described above.

While the invention has been illustrated and described as embodied in a bottling machine, it is not intended to be limited to the details shown, since various modifications and structural changes may be made without departing in any way from the spirit of the present invention.

What is claimed as new and desired to be protected by Letters Patent is set forth in the appended claims:

1. In a filling machine for discharging a liquid into a plurality of containers, a combination comprising a tank for storing said liquid; a filling head adapted for sealingly engaging each container and including a filling pipe; a pressure gas return conduit and a pressure release conduit; an annular channel arranged around said tank and containing gas at an intermediate pressure that is lower than the pressure in the tank and higher than the atmospheric pressure; a pressure control space surrounding said filling pipe and communicating with the interior of the container to be filled, a control valve provided between said annular channel and said pressure control space, said control valve including a projecting control pin; and timing means operatively connected to said control valve for adjustably opening said control valve for a predetermined time interval corresponding to a desired quick filling phase of the liquid discharging operation, said timing means including a two arm lever having one arm in contact with said control pin, a resetting element coupled to the other arm of said lever for counteracting the closing of said control valve for a predetermined time interval.

2. A combination as defined in claim 1, wherein said control valve communicates with said control space through a changeover conduit that includes an additional cylindrical space, said control valve having an extended postion integrally connected to a control pin and projecting into said cylindrical space to form a pressure relieving valve, said cylindrical space being connected to said changeover conduit by a throttle conduit and said extended piston being displaceable between two working positions.

3. A combination as defined in claim 2, wherein said control pin and said extended piston of said control valve have a central passage communicating with said cylindrical space, said pressure relieving valve having an auxiliary control rod passing through said center passage and slightly projecting outwardly above said control pin and the other end of said control rod supporting a piston disc of said pressure relieving valve.

4. A combination as defined in claim 1, further including means for rotating said tank and said intermediate pressure vessel on a circular track, and means for mechanically actuating said control valve to control pressure difference between said tank and the container to be filled.

5. A device as defined in claim 1, wherein the pressure in said tank is at a ratio of 2.0:1.5 to the pressure in said intermediate pressure vessel.

6. In a filling machine for discharging a liquid into a plurality of containers, a combination comprising a tank for storing said liquid; a filling head adapted for sealingly engaging each container and including a filling pipe; a pressure gas return conduit and a pressure release conduit; an annular channel arranged around said tank and containing gas at an intermediate pressure that is lower than the pressure in the tank and higher than the atmospheric pressure; a pressure control space surrounding said filling pipe and communicating with the interior of the container to be filled, a control valve provided between said annular channel and said pressure control space, said control valve including a control pin; and timing means operatively connected to said control valve for adjustably opening said control valve for a predetermined time interval corresponding to a desired quick filling phase of the liquid discharging operation, said timing means including s solenoid coupled to said control pin and a mechanically activated switching element coupled to a cam for energizing said solenoid for a predetermined time interval.

7. In a filling machine for discharging a liquid into a plurality of containers, a combination comprising a tank for storing said liquid; a filling head adapted for sealingly engaging each container and including a filling pipe; a pressure gas return conduit and a pressure release conduit; an annular channel arranged around said tank and containing gas at an intermediate pressure that is lower than the pressure in the tank and higher than the atmospheric pressure; a pressure control space surrounding said filling pipe and communicating with the interior of the container to be filled, a control valve provided between said annular channel and said pressure control space; said control valve having a control pin, said control pin being provided with a helical thread and with a resetting spring urging said valve into its closing position, and with a braking element for delaying the resetting movement of said pin, and timing means operatively connected to said control valve for adjustably opening said control valve for a predetermined time interval corresponding to a desired quick filling phase of the liquid discharging operation.

8. In a filling machine for discharging a liquid into a plurality of containers, a combination comprising a tank for storing said liquid; a filling head adapted for sealingly engaging each container and including a filling pipe; a pressure gas return conduit and a pressure release conduit; an annular channel arranged around said tank and containing gas at an intermediate pressure that is lower than the pressure in the tank and higher than the atomospheric pressure; a pressure control space surrounding said filling pipe and communicating with the interior of the container to be filled, a control valve provided between said annular channel and said pressure control space; timing means operatively connected to said control valve for adjustably opening said control valve for a predetermined time interval corresponding to a desired quick filling phase of the liquid discharging operation; and electrooptical means arranged at the path of movement of said tank for detecting the annular position thereof and to generate a control impulse for closing said control valve at the end of said quick filling phase.

9. A combination as defined in claim 8, wherein the horizontal and vertical position of said electrooptical elements is adjustable.

10. In a filling machine for discharging a liquid into a plurality of containers, a combination comprising a tank for storing liquid under a first pressure; means for discharging liquid from the tank into a container and including a valve member movable between a first position in which no liquid flows from said tank into the container and a second position in which the liquid is permitted to flow from the tank into the container, so that pressure in the container at least during an initial portion of the filling operation is equal to said first pressure in said tank and the liquid flows into the container from said tank due to the force of gravity and at a first speed; means actuatable for decreasing the pressure in the container to a second pressure substantially below said first pressure at least during a predetermined portion of the filling operation, to thereby cause the liquid to flow into the container at a second speed which substantially exceeds said first speed; and means for actuating said pressure decreasing means for a predetermined time interval corresponding to said predetermined portion of the filling operation.

* * * * *